US006170239B1

(12) United States Patent
Focke et al.

(10) Patent No.: US 6,170,239 B1
(45) **Date of Patent: *Jan. 9, 2001**

(54) PROCESS AND APPARATUS FOR PRODUCING PACKS WITH GLUED FOLDING TABS

(75) Inventors: Heinz Focke, Verden; Hans-Jürgen Bretthauer, Bremen; Thomas Häfker, Langwedel, all of (DE)

(73) Assignee: Focke & Co. (GmbH & Co.), Verden (DE)

( * ) Notice: Under 35 U.S.C. 154(b), the term of this patent shall be extended for 0 days.

This patent is subject to a terminal disclaimer.

(21) Appl. No.: 09/257,297

(22) Filed: Feb. 25, 1999

(30) Foreign Application Priority Data

Mar. 3, 1998 (DE) ..... 198 08 881

(51) Int. Cl.[7] ..... B65B 7/20

(52) U.S. Cl. ..... 53/491; 53/406; 53/234; 53/376.5; 53/383.1

(58) Field of Search ..... 53/491, 466, 228, 53/234, 383.1, 376.5

(56) References Cited

U.S. PATENT DOCUMENTS

| | | | | |
|---|---|---|---|---|
| 3,982,375 | * | 9/1976 | Focke | 53/228 |
| 4,838,846 | * | 6/1989 | Focke et al. | 53/383.1 |
| 5,188,695 | | 2/1993 | Colten . | |
| 5,946,890 | * | 9/1999 | Focke et al. | 53/234 |
| 5,974,768 | * | 11/1999 | Scholzke et al. | 53/383.1 |

FOREIGN PATENT DOCUMENTS

| | | |
|---|---|---|
| 37 01 427 | 7/1988 | (DE) . |
| 196 41 151 | 4/1998 | (DE) . |
| 835 810 | 4/1998 | (DE) . |
| 196 48 445 | 5/1998 | (DE) . |
| 34 28 801 | 2/1986 | (EP) . |
| 820 931 | 1/1998 | (EP) . |
| 364 447 | 1/1932 | (GB) . |

* cited by examiner

*Primary Examiner*—Eugene Kim
(74) *Attorney, Agent, or Firm*—Sughrue, Mion, Zinn, Macpeak & Seas, PLLC

(57) ABSTRACT

Apparatus, namely folding turret (20), for producing (cigarette) packs (10), in the case of which a blank, in particular an outer paper blank (13), has folding tabs, namely side tabs (18, 19), which are connected to one another by spots of glue (28). The spots of glue (28) are transferred onto the side tab (18) by glue nozzles (31), the guidance of the movement path of the packs (10) relative to the glue nozzles (31) being such that, following a portion of glue (29) for the spot of glue (28), unwanted portions (32) emerging from the glue nozzle (31) are intercepted by the radially inner side tab (19). For this purpose, said radially inner side tab may be formed so as to be in an oblique position.

12 Claims, 6 Drawing Sheets

34
30
31
35
32
28
43
46
19
15
16
42
47
13
18

20
37
34
27
30
31
37
18
48
43
49
19
41
42
10
44
45
50

PROCESS AND APPARATUS FOR PRODUCING PACKS WITH GLUED FOLDING TABS

BACKGROUND OF THE INVENTION

The invention relates to a process for producing packs, in particular cigarette packs, in the case of which folding tabs are provided with spots of glue and, in order for these spots of glue to be applied, the packs are moved past a stationary glue unit, which transfers portions of glue from glue nozzles onto the folding tabs during the movement of the packs. The invention also relates to an apparatus for carrying out the process.

Packs, in particular cigarette packs, have folding tabs which are connected to one another, or to other pack parts, by glue during production of the packs. The practice in recent times, in the case of high-performance cigarette packaging machines, is for the glue to be applied to the folding tabs or blanks by glue nozzles. A glue unit is provided with one or more glue nozzles which cyclically discharge small portions of glue and transfer them onto the folding tabs for the purpose of forming spot-like applications of glue.

SUMMARY OF THE INVENTION

The object of the invention is to provide, during the application of glue or spots of glue to packs or blanks, better protection against contamination of the packs or blanks and, in particular, of the packaging machine or the machine elements in the region of a glue station.

In order to achieve this object, the process according to the invention is characterized by the following features:

a) the portions of glue are applied to an (inner) folding tab directed towards the glue unit or the glue nozzle, b) the portions of glue are ejected from the glue nozzles at an angle (oriented in the conveying direction) to the plane of the folding tab, such that a second folding tab, remote from the nozzle unit or the glue nozzle, intercepts randomly discharged particles of glue.

The invention is based on the finding that, in addition to the actual portion of glue for the purpose of producing the application of glue, the glue nozzles or glue units, which operate at high cycle speeds, randomly discharge very small quantities of glue which, as particles of glue, are for the most part not intercepted by the folding tab which is to be glued. The process according to the invention provides that another region of the pack, namely another folding tab, intercepts the randomly discharged particles of glue as a result of its relative position during transportation in the region of the glue unit. In specific terms, this is achieved in that a folding tab which is more remote from the glue nozzle, and is not intended to be provided directly with glue, intercepts the particles of glue, during continued movement, as a result of the oblique position of the glue unit or of the glue nozzle.

Further measures are also provided according to the invention for the purpose of removing the secondary portions of glue. Thus, the region of a glue station is subjected to the action of suction air, with the result that the relatively small secondary portions of glue are extracted by suction as a result of the relatively low inherent weight.

In the case of the apparatus according to the invention, the glue unit or the glue nozzles is/are directed at an angle to the conveying path of the packs, such that, as the portions of glue are being fed, part of the pack, namely a folding tab, runs along after the folding tab which is to be glued and consequently receives the secondary portions following the portion of glue. Furthermore, the apparatus is provided with a suction-extraction element in the region of a glue station. Moreover, a screen is arranged between the movement path of the packs and the glue unit or the glue nozzles and has a comparatively small through-passage opening for the portion of glue.

BRIEF DESCRIPTION OF THE DRAWINGS

Further details of the process and of the apparatus are explained in more detail here below with reference to the exemplary embodiments illustrated in the drawings, in which.

DESCRIPTION OF PREFERRED EMBODIMENTS

Figure 1:
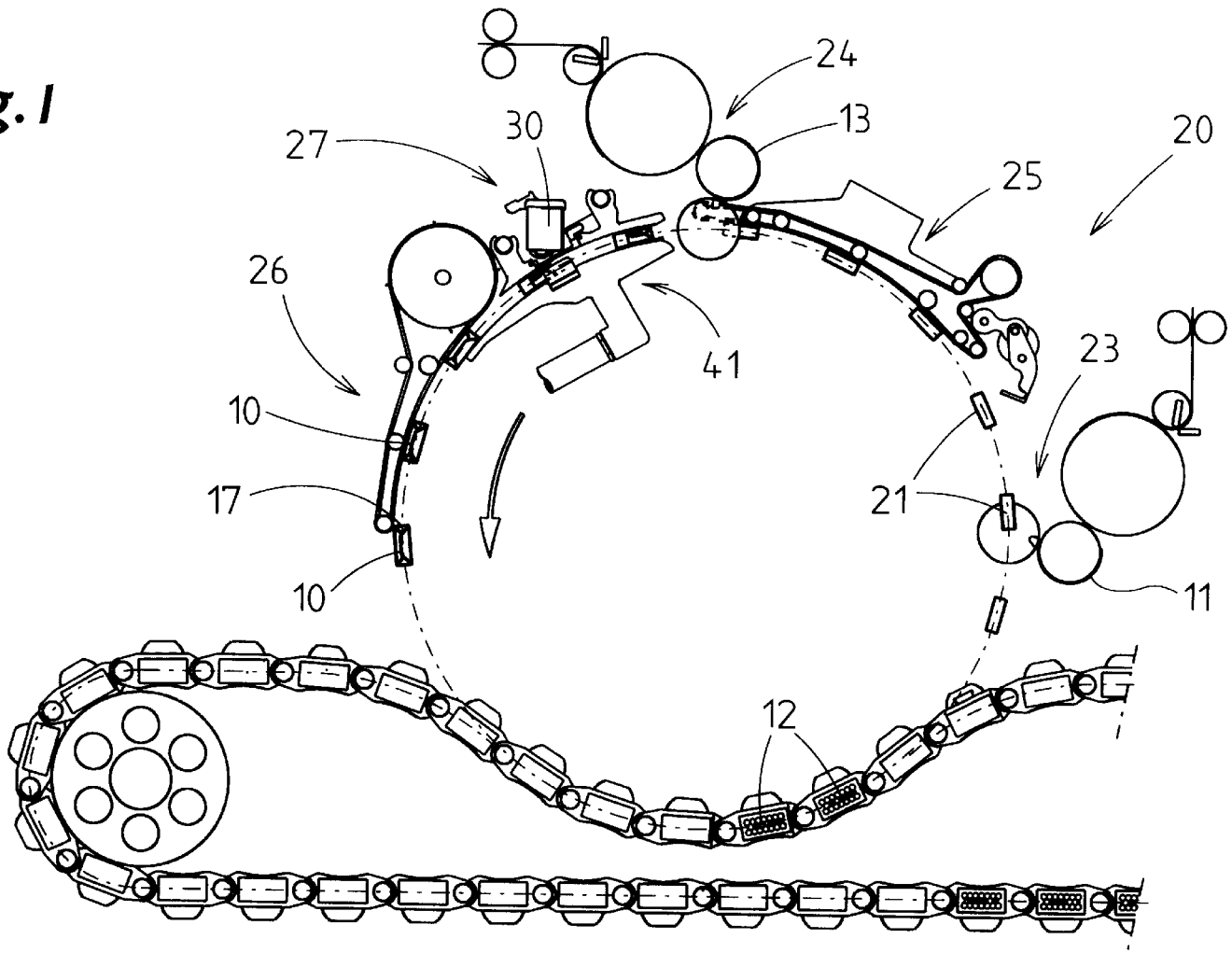
FIG. 1 shows a schematic side view of a region of a packaging machine for cigarettes.

The drawings relate to a process and apparatus for producing packs 10, to be precise cigarette packs. These packs are so-called soft-carton packs. The latter comprise an inner wrapper 11 made of paper or tin foil for the purpose of wrapping a cigarette group 12. The inner wrapper 11 is enclosed on the outside by a carton-like outer wrapper made of a paper blank or some other suitable material. The parts of the pack 10, in particular the carton-like outer wrapper or the paper blank 13, form folding tabs which are connected to one another, or to other pack parts, by adhesive bonding. Thus, for example, base tabs 14 (FIG. 8) are connected to one another by glue. Following folding to form a base wall, the base tabs 14 are of trapezoidal configuration, corresponding to base tabs 15, 16 of the inner wrapper 11.

The present exemplary embodiment concerns the adhesive bonding of folding tabs in the region of a narrow side wall 17 of a blank, namely of the outer wrapper, that is to say of the paper blank 13. The latter is arranged 30 and/or folded so as to form, in the region of the side wall 17—which is at the rear in the conveying direction of the pack 10—partially overlapping folding tabs, namely side tabs 18, 19. The inner side tab 18 is designed with a smaller width than the outer side tab 19. The latter overlaps the side wall 17 approximately over the full width. For the purpose of connecting the side tabs 18, 19, glue is applied to at least one side tab, to be precise to the outside of the inner side tab 18, before said side tab 18 is folded into the correct position.

Figure 8:
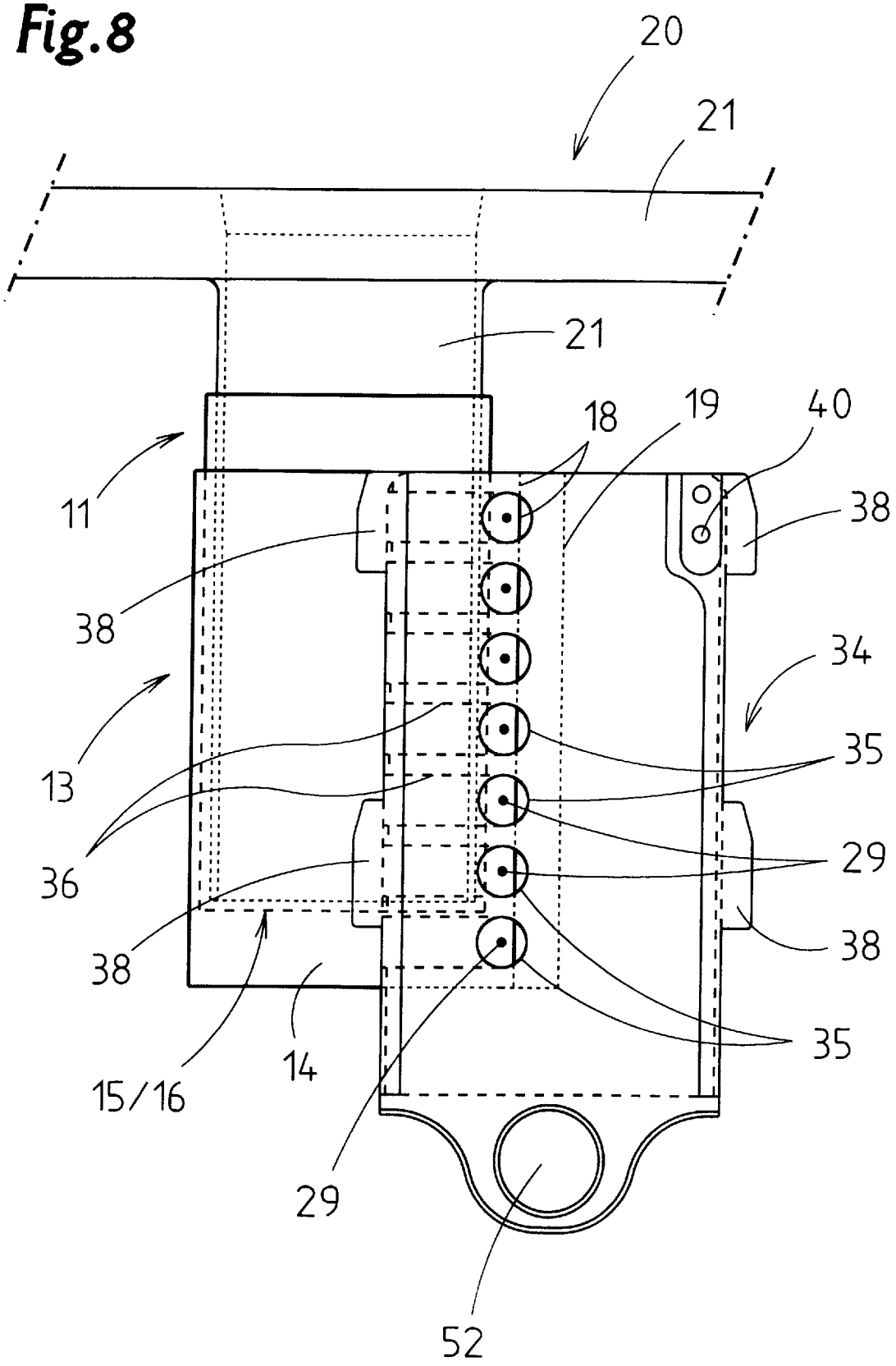
FIG. 8 shows, on an enlarged scale, a detail of the apparatus according to FIG. 6 in a radially directed plan view.
Figure 9:
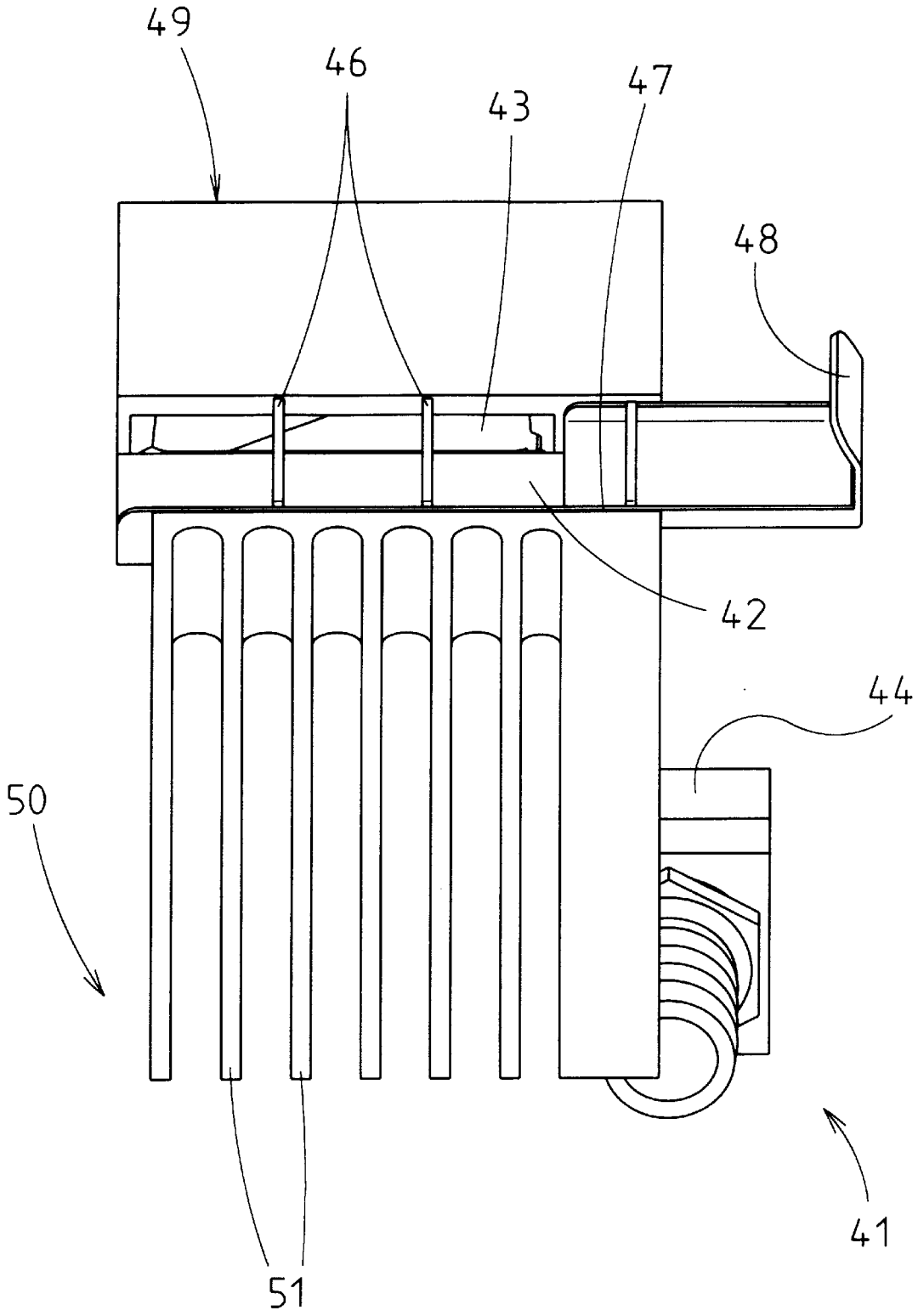
FIG. 9 shows, likewise on an enlarged scale, a further detail of the apparatus according to FIG. 6.

The packs 10 are produced in the region of a folding turret 20. The latter is provided along the circumference with a plurality of receiving means, namely with folding mandrels 21, for one pack 10 in each case. These mandrels are elongate hollow bodies which are open at both ends and have one end fitted on a carrier, namely a turret plate 22. The blanks for the pack 10, namely the inner wrapper 11 and the paper blank 13, are folded one after the other on the outside of the folding mandrel 21. As is shown in FIG. 8, for example the outer paper blank 13 is positioned in the form of a U around the folding mandrel 21 or around the already folded inner wrapper 11 such that base tabs 14 project beyond the folding mandrel at the free end of the latter. On that side of the folding mandrel 21 which is at the rear in the direction of rotation, the side tabs 18 and 19 are formed as projections of the paper blank 13.

The folding turret 20 is driven in rotation preferably continuously during production. The folding mandrels 21, and thus the packs 10, are therefore transported along a circular movement path. In the region of a first blank station 23 the inner wrapper 11, and in the region of a second blank station 24 the paper blank 13, is positioned against the folding mandrels 21, which are moved past one after the other. Following the blank stations 23, 24, folding units 25, 26 are respectively assigned to the folding turret 20 for the purpose of folding the blanks 11, 13.

For the purpose of connecting the side tabs 18 and 19, the packs 10, following the blank station 24, are conveyed through a gluing station 27 and provided with glue in the region of the same. In this case, a number, namely a series, of spots of glue 28 are applied to the side tab 18. These spots of glue are formed by portions of glue 29 being sprayed or transferred onto the side tab 18.

For the purpose of producing spots of glue 28 or the portions of glue 29, a glue unit 30 is positioned, in the gluing station 27, in a stationary manner outside the movement path of the folding turret 20. The glue unit 30 comprises preferably a plurality of glue nozzles 31 which are arranged one beside the other in the axial direction and each discharge a portion of glue 29 for a pack 10 which is running past. The glue nozzles 31 may be designed in a suitable, known manner, as can the glue unit 30, and, for an example, you are referred to EP 97 114 970.3. The glue unit 30 and the glue nozzles 31 are actuated in time with the production cycle of the packaging machine, namely in accordance with the packs 10 which are moved past by the folding turret 20. The glue nozzles 31 are actuated such that the portion of glue 29 discharged, over a free displacement path, comes into contact approximately centrally with the side tab 18 and forms the spot of glue 28 there, in the present case a plurality of spots of glue 28 arranged one beside the other in the longitudinal direction of the side tab 18.

When very small portions of glue are discharged within very short cycle times, it is not possible to avoid the situation where random particles of glue or relatively small unwanted portions 32 of glue are freed in addition to the formed portion of glue 29. These unwanted portions of glue for the most part follow the portion of glue 29 discharged first of all from the glue nozzle 31. The unwanted portions 32 may follow the movement path of the portion of glue 29. However, it is also possible for particles of glue to take other movement paths. A number of measures are provided in order to counteract adverse effects brought about by these unwanted portions 32 or random particles of glue.

Figures 4, 5:
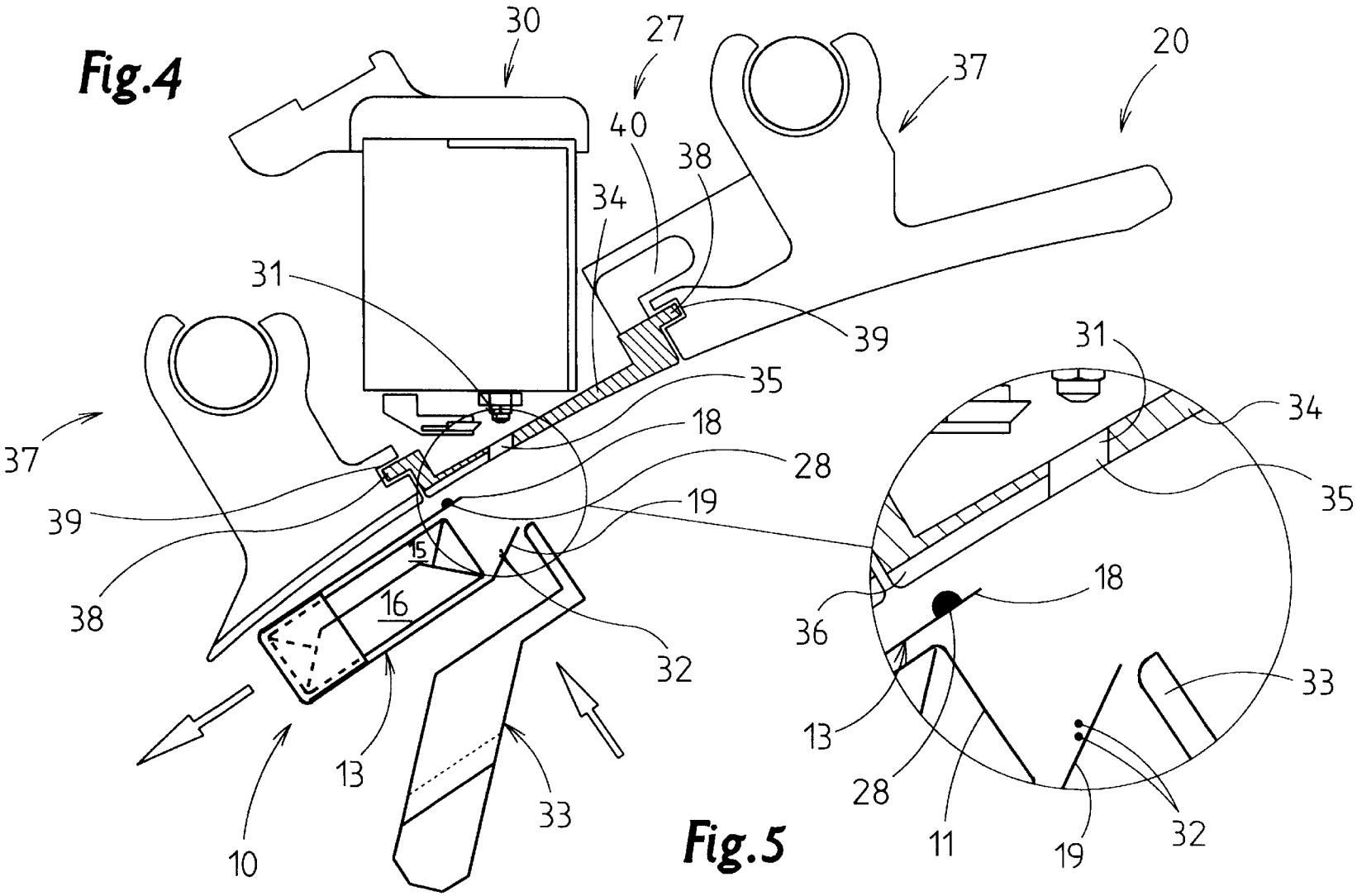
FIG. 4 shows the apparatus according to FIG. 3 during a phase following the gluing operation.
FIG. 5 shows part of FIG. 4 in a manner analogous to FIG. 3.

The portion of glue 29 is fed to the side tab 18 along a particular movement path, such that particles of glue or unwanted portions 32 which follow one after the other in time are intercepted by a folding tab, of the pack 10, which subsequently passes into the region of the feed of glue. In the case of the present example, said folding tab is the outer side tab 19, which, as a result of corresponding arrangement of the pack 10 in the folding turret 20, is located on the inside in the radial direction, that is to say is more remote from the glue nozzle 31. However, the relative position is selected such that first of all the portion of glue 29 is transferred onto the side tab 18 and then the unwanted portions 32 are intercepted by the side tab 19 (FIG. 4, FIG. 5). The position of the glue nozzles 31 relative to the packs 10 and the conveying speed of the latter are coordinated with one another such that the side tab 18 has already left the movement path of the glue when the unwanted portions 32 pass into this region. These unwanted portions thus pass further into the interior of the folding turret 20 until they reach the side tab 19.

Figures 2, 3:
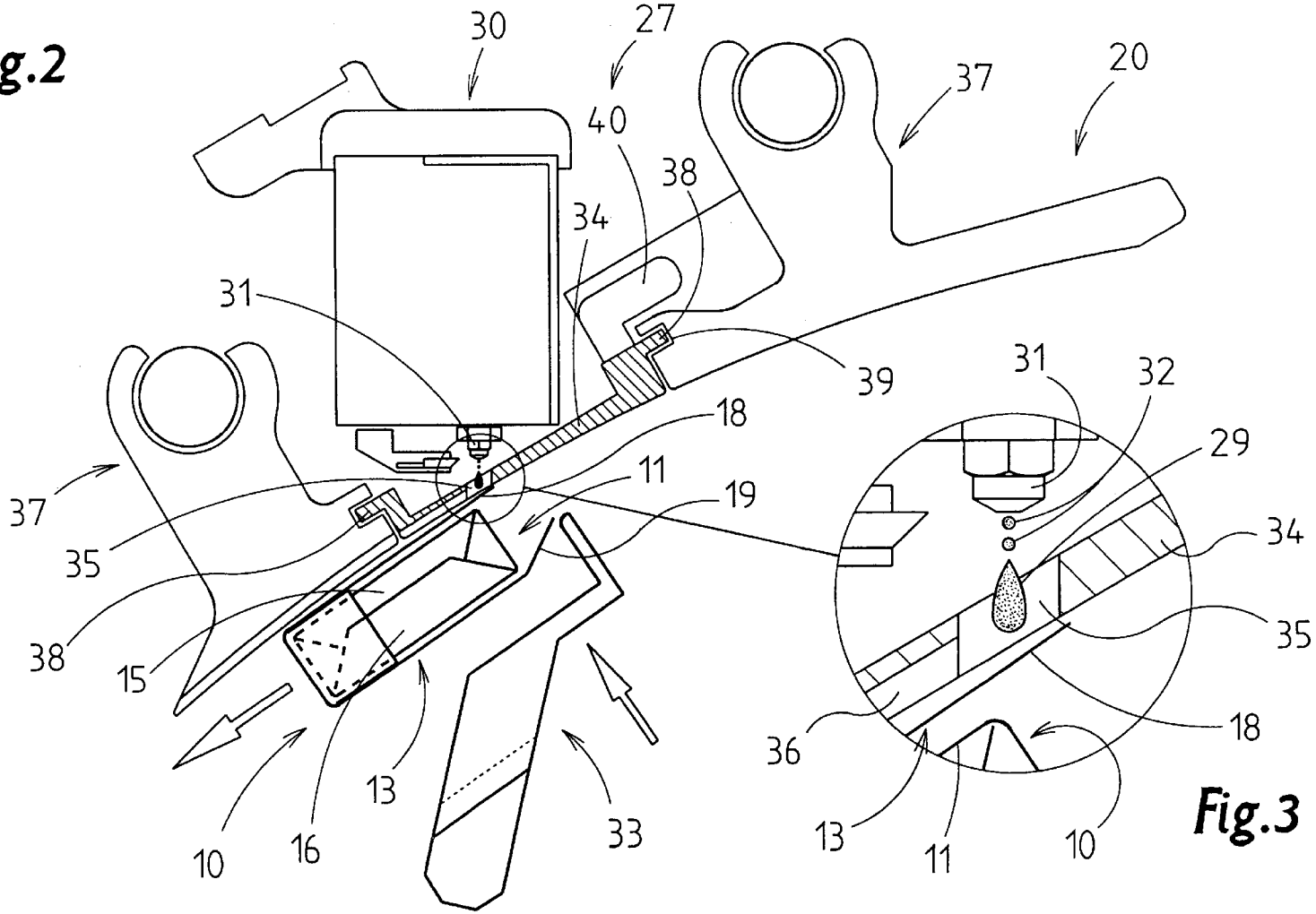
FIG. 2 shows, on enlarged scale and partly in section, glue station of the apparatus according to FIG. 1, likewise in side view.
FIG. 3 shows, on a vastly enlarged scale, part of the detail according to FIG. 2.

The intercepting or collecting effect of the side tab 19 can be further increased in that it is prefolded into an oblique position (FIG. 2, FIG. 4, FIG. 5). In this position, the side tab 19 has a funnel-like action as it intercepts particles of glue or unwanted portions 32. In this case, the side tab 19 is preformed in the direction of the side wall 17 of the pack 10. This prefolded position can be achieved by a folding element 33, which is arranged on the folding turret 20 and has the task of folding the side tab 19 into the definitive position, where it rests on the side wall 17.

The intercepting effect of the side tab 19 is achieved by a particular position of the transported packs 10 relative to the glue unit 30 or relative to the glue nozzle 31. This is because the glue nozzle 31, or the ejection and movement direction of the portion of glue 29, is directed obliquely with respect to the movement path of the packs 10, and thus also with respect to the large surfaces thereof. The relative position results first of all in the folding tab directed towards the glue nozzle 31, namely the side tab 18, and then in the radially inner folding tab, namely the side tab 19, being guided past the movement path of the glue. This makes it possible for the unwanted portions 32 following the portion of glue 29 to be intercepted by the side tab 19.

The relative position is provided such that the gluing station 27 or the glue unit 30 is positioned in a downwardly guiding region of the folding turret 20, which rotates in an upright plane. In this position, the packs 10 are arranged obliquely with respect to the vertical. Upright positioning of the glue nozzles 31 ensures that the latter are directed at the desired angle relative to the movement path of the packs 10. The deviation from a radially directed nozzle unit or from radially directed glue nozzles 31 is 30°here.

Following gluing of the side tab 18, the tabs, namely side tabs 18, 19, are folded in the region of the folding unit 26 in a known manner, the side wall 17 being formed in the process.

A further measure taken to protect against randomly discharged particles of glue is constituted by arranging a covering or screen 34 in the region of the gluing station 27. This covering or screen is a panel which extends in the form of an arc along a sub-region of the movement path of the packs 10, to be precise in the region of the glue nozzles 31. This screen is provided with one or more through-passage openings 35 directly adjacent to, or beneath, the glue nozzle 31. If a plurality of glue nozzles 31 are arranged one beside the other, each is assigned a through-passage opening 35 of this type. Said opening is a comparatively small obliquely directed bore through which the portion of glue 29 for gluing the side tab 18 passes (FIG. 3).

The screen 34 is arranged directly adjacent to the movement path of the side tabs 18. This side tab is moved at a small distance away from the screen 34 or can rest on the same. In order that, as the pack 10 is moved on further, and the side tab 18 rests on the screen 34, the spot of glue 28 applied is not smeared, a circumferentially extending groove 36 is formed in the screen 34, following the through-passage opening 35, on the side directed towards the side tab 18. The groove 36 adjoins the through-passage opening 35, and thus runs in the region of the spot of glue 28.

In the case of the present exemplary embodiment, the screen 34 is arranged in a fixed mount 37. The panel-like screen 34 is provided with lateral guide legs 38. The latter pass into an axis-parallel guide groove of the mount 37. It is thus possible for the screen 34 to be drawn out of the mount 37 in the axis-parallel direction for cleaning purposes. Particles of glue are collected on the outside of the screen 34.

The presence of the screen 34, or the correct position of the same, is checked by a monitoring element, namely by an initiator 40, that is to say a contactless sensor, which produces an error signal if the screen 34 is missing or is not in the correct position.

On one side, the panel-like screen 34 is provided with an extension 52 which allows the screen 34 to be drawn out of the mount 37.

A further special feature is that small, lightweight particles of glue can be removed by being extracted by suction. For this purpose, the gluing station 27 is assigned a suction unit 41. The latter produces, in the region of the gluing on the radially inner side of the movement path of the packs 10, a preferably constant negative pressure, by means of which small particles are extracted by suction.

Figures 6, 7:
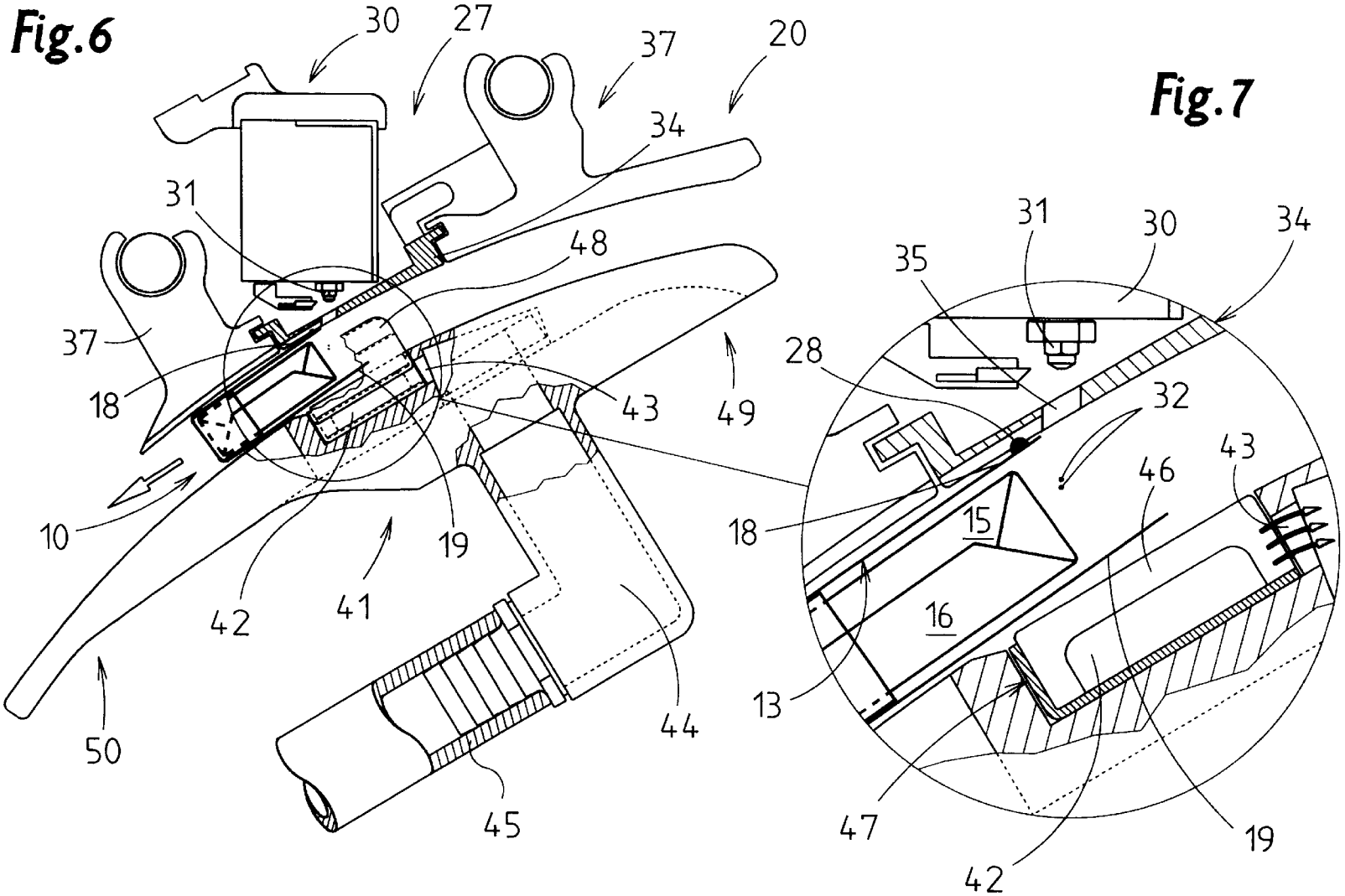
FIG. 6 shows the region of the glue station with an additional element for removing unwanted glue.
FIG. 7 shows, on a vastly enlarged scale, part of the detail according to FIG. 6.

In the case of the present exemplary embodiment, the suction unit 41 is provided with a suction chamber adjacent to the glue unit 30 or the glue nozzles 31. This suction chamber is open on the side directed towards the packs 10 or the glue nozzles 31. Accordingly, the suction chamber 42 has a U-shaped cross section. The suction chamber 42 is connected to a suction-extraction stub 44 via a side opening 43 (FIG. 7). Said stub is adjoined by a suction line 45 which leads to a negative-pressure source.

The suction chamber 42 extends, in the axis-parallel direction, transversely with respect to the movement path of the packs 10. Circumferentially oriented supporting brackets 46 are arranged within the suction chamber 42. These brackets extend approximately as far as the radially inner movement plane of the packs 10. The supporting brackets 46 prevent parts of the pack 10, in particular adjacent side tabs 19, from passing into the suction chamber 42 as a result of the negative pressure.

The suction chamber 42, or part of the same, is designed as an insert 47 which can be displaced in the axis-parallel direction. This insert is a shaped part with a cross section in the form of a U. A handle 48 is arranged on a free end region or on an extension of the insert 47, outside the movement path of the packs 10. By virtue of said handle being gripped, it is possible for the insert 47 to be drawn out of the suction chamber 42 in the axis-parallel direction, in particular for cleaning purposes.

In the movement direction of the packs 10, the region of the suction chamber 42 is adjoined on both sides by a supporting body 49, 50 in each case. The supporting body 49, which is located upstream of the suction chamber 42 in the movement direction of the packs 10, has a solid surface area with a supporting surface configured approximately in the form of an arc of a circle on the side directed towards the packs 10. The supporting body 50, which follows the suction chamber 42, is of fork-like design with supporting fingers 51 spaced apart transversely from one another. These allow the through-passage of processing elements, for example folding elements, for the respectively processed pack 10.

Particles of glue can also be extracted by suction on the radially outer side of the folding turret 20 in the region of the gluing station 27, adjacent to the glue nozzles 31. In this case, the negative pressure has to be set such that the portion of glue 29 can make its way to the pack 10 in an unobstructed manner, while small, randomly moving particles of glue are extracted by suction.

List of designations

10 Pack
11 inner wrapper
12 cigarette group
13 Paper blank
14 Base tab
15 Base tab
16 Base tab
17 Side wall
18 Side tab (inside)
19 Side tab (outside)
20 Folding turret
21 Folding mandrel
22 Turret plate
23 Blank station
24 Blank station
25 Folding unit
26 Folding unit
27 Gluing station
28 Spot of glue
29 Portion of glue
30 Glue unit
31 Glue nozzle
32 Unwanted portion
33 Folding element
34 Screen
35 Through-passage opening
36 Groove
37 Mount
38 Guide leg
39 Guide groove
40 Initiator
41 Suction unit
42 Suction chamber
43 Side opening
44 Suction-extraction stub
45 Suction line
46 Supporting bracket
47 Insert
48 Handle
49 Supporting body
50 Supporting body
51 Supporting finger
52 Extension

What is claimed is:

1. A process for producing packs (10), in which folding side tabs (18, 19) of each pack are provided with spots (28) of glue, and in which, for gluing purposes, the packs (10) are conveyed in a direction past a stationary glue unit (30) containing glue nozzles (31) which discharge portions (29) of glue during the conveying of the packs (10), and transfer the glue portions to the folding side tabs (18), said process further comprising the steps of:

a) applying a glue portion (29) to a first one (18) of the folding side tabs which is directed towards the glue nozzles (31), and b) discharging the glue portions (29) from the glue nozzles (31) at an angle, oriented in the conveying direction of the packs, to a plane of the first folding side tab (18), such that a second one (19) of the folding side tabs, which is remote from the glue nozzles (31) intercepts unwanted portions (32) or particles of glue discharged randomly from the glue nozzles (31) following each glue portion (29).

2. The process according to claim 1, further comprising the step of prefolding the second folding side tab, remote from the glue nozzles (31), so that is assumes a funnel-like, obliquely directed relative position at an acute angle to a side surface of the pack contents.

3. The process according to claim 1, further comprising the step of extracting by suction the unwanted portions (32) or particles of glue that are discharged randomly from the glue nozzles (31).

4. An apparatus for producing packs (10) which are transported by an endless conveyor (20), said apparatus comprising a glue unit (30) having glue nozzles (31) which transfer, to folding side tabs (18, 19) of each pack, glue spots (28) during transportation of the packs, wherein the glue nozzles (31) are directed at an acute angle to a plane of the transportation path of the packs (10), such that portions of glue (29) discharged from the glue nozzles (31) are received by a first one (28), and wherein subsequent particles or unwanted portions (32) of glue are received by a following region of a pack (10).

5. The apparatus according to claim 4, wherein the endless conveyor is a folding turret (20), wherein the first folding side tab is an inner side tab (18), wherein each pack has another, second folding side tab (19), and wherein blanks (13) of the packs (10) are arranged on a folding mandrel (21) of the folding turret (20), such that the inner side tabs (18) and the outer side tabs (19) project beyond a rear side of the folding mandrel (21) in a direction of rotation of the turret, wherein each inner side tab (18) is positioned on an outside of the tuffet, in a radial direction, and the outer side tab (19) is positioned on the inside in a radial direction, so that the glue portion (29) is fed onto the radially outer side tab (18) and, as a result of the acute angle of the glue nozzles (31), the particles or unwanted portions (32) are fed to the radially inner side tab (19).

6. Apparatus according to claim 4, characterized in that the radially inner side tab (19) is formed so as to be in a funnel-like oblique position.

7. Apparatus according to claim 4, characterized in that the glue unit (30) with glue nozzles (31) is arranged in a downwardly conveying region of the folding turret (20), which is driven in rotation in an upright plane, and in that the glue nozzles (31) are arranged in a vertical position such that a nozzle axis or the conveying direction of the portions of glue (29) is directed at an angle of 30° to an (imaginary) radial plane.

8. Apparatus according to claim 4, characterized in that a screen (34) is arranged, as a panel-like covering, between the glue unit (30) or the glue nozzles (31), on the one hand, and the packs (10) or the transporation path of the same, on the other hand, and has a through-passage opening (35) for each glue nozzle (31).

9. The apparatus according to claim 4, characterized in that, arranged in a region of the glue nozzles (31) is a suction unit (41) for extracting the particles of glue by suction.

10. Apparatus according to claim 9, characterized in that the suction unit (41) has a suction chamber which is formed on a side opposite from the glue nozzles (31) and is open on a side directed towards the packs (10), the suction chamber (42) being connected to a suction-extraction stub (44).

11. Apparatus according to claim 10, characterized in that arranged in the suction chamber (42) is an insert piece (47) which is removable.

12. Apparatus according to claim 9, characterized in that supporting bodies (49, 50), which extend in a circumferential direction of the folding turret (20) and on which the packs (10) or the blanks or folding tabs can rest, are formed on both sides of the suction unit (41).

* * * * *